US005466277A

United States Patent [19]

Miura et al.

[11] Patent Number: 5,466,277

[45] Date of Patent: Nov. 14, 1995

[54] STARTING POWDER FOR PRODUCING SINTERED-ALUMINUM ALLOY, METHOD FOR PRODUCING SINTERED PARTS, AND SINTERED ALUMINUM ALLOY

[75] Inventors: Shin Miura; Youichi Hirose ; Mitsuaki Sato, all of Saitama, Japan

[73] Assignee: Showa Denko K.K., Tokyo, Japan

[21] Appl. No.: 219,700

[22] Filed: Mar. 30, 1994

Related U.S. Application Data

[63] Continuation of Ser. No. 725,806, Jul. 10, 1991, abandoned.

[30] Foreign Application Priority Data

Jul. 10, 1990 [JP] Japan ..... 2-183638

[51] Int. Cl.[6] ..... B22F 1/00; C22C 21/02

[52] U.S. Cl. ..... 75/255; 75/228; 75/950; 148/698; 148/700; 419/29; 419/32; 419/39; 419/46; 419/47; 419/48; 419/54; 420/534; 420/537

[58] Field of Search ..... 75/255, 228, 950; 420/534, 537; 419/26, 32, 39, 46, 47, 48, 54, 29; 148/698, 700

[56] References Cited

U.S. PATENT DOCUMENTS 3,325,279 6/1967 Lawrence et al. ..... 75/255
4,460,541 7/1984 Singleton et al. ..... 419/47

FOREIGN PATENT DOCUMENTS 0147769 7/1985 European Pat. Off. .
53-128512 11/1978 Japan .
59-157202 9/1984 Japan ..... 420/534
1-201450 8/1989 Japan .

OTHER PUBLICATIONS

ASM *Metals Handbook* (9th Edition), vol. 7: *Powder Metallurgy*, 1984; p. 10.

ASTM Designation B 595–84, "Standard Specification for Sintered Aluminum Structural Parts"; p. 458, Table 1, Table 2, and Appendix (Table XI); 1984.

Powder Metallurgy: Applications, Advantages and Limitations; Erhard Klar, editor; " Aluminum P/M–Properties and Applications", Generous and Montgomery, pp. 211–234; 1983.

JRCM News by The Japan Research and Development Center for Metals; "Showa Denko K.K.", Dec. 1990 (No. 8).

S. Miura, et al., "The Effects of Varied Alloying Methods on the Properties of Sintered Aluminum Alloys", pp. 571–574; Proceedings of 1993 Powder Metallurgy World Congress, Jul. 1993; Kyoto, Japan.

*Primary Examiner*—David A. Simmons
*Assistant Examiner*—Robert R. Koehler
*Attorney, Agent, or Firm*—Armstrong, Westerman, Hattori, McLeland & Naughton

[57] ABSTRACT

A sintered Al-alloy, which has a composition of 0.2 to 2.0% of Mg, 10.0 to 35.0% of Si, from 0.2 to 4.0% of Cu, and Al and unavoidable impurities in balance, is produced by using a mixture of the main powder (10.0–35.0% of Si, 0.2–2.0% of Cu, and Al and unavoidable impurities in balance) and at least one metal or mother-alloy powder selected from (a)–(i): (a) Mg powder; (b) Al—Mg powder; (c) Al—Cu powder; (d) Al—Mg—Si powder; (e) Al—Cu—Si powder; (f) Al—Mg—Cu powder; (g) Al—Mg—Cu—Si powder; (h) Mg—Cu powder; and, (i) Mg—Cu—Si powder.

16 Claims, 2 Drawing Sheets

STARTING POWDER FOR PRODUCING SINTERED-ALUMINUM ALLOY, METHOD FOR PRODUCING SINTERED PARTS, AND SINTERED ALUMINUM ALLOY

This application is a Continuation of application Ser. No. 07/725,806 filed Jul. 10, 1991, now abandoned.

BACKGROUND OF INVENTION

1. Field of Invention

The present invention relates to starting powder for producing sintered parts which consists of an Al—Si based alloy powder exhibiting low thermal expansion and high ductility. The sintered parts mentioned above can be used for office machines and machines related to computers.

The present invention also relates to a method for producing sintered parts and sintered aluminum alloy.

2. Description of Related Arts

It has recently become necessary in the field of office machines and computer-related machines to reduce electric power consumption and to prevent noise generated by machine vibration. Improvement of the portability of such machines is also necessary. In order to meet such requirements, light weight aluminum alloys are increasingly being used for the parts of such machines. The demand is for aluminum alloys with a low coefficient of thermal expansion such that there is no mismatch of the machine parts even under environmental temperature changes.

It is an object of the present invention to provide an inexpensive method for producing the Al—Si based alloy parts which can be used for the applications as described above and which exhibit a low coefficient of thermal expansion.

Heretofore, die casting was the conventional method for producing the complicated parts of an Al—Si based alloy with a low coefficient of thermal expansion. Die casting is advantageous in the point that three-dimensionally complicated shapes can be produced. On the other hand, the dimension accuracy of the die cast products is insufficient. In addition, since the die cast articles must have a taper for removing the same from a mold, they are not infrequently subjected after the casting to expensive machining. Furthermore, the reliablity of the die cast products is not sufficient because cast defects, such as blow holes, degrade the properties.

According to another method employed for producing the Al—Si based alloy parts with a low coefficient of thermal expansion, an ingot is produced by melting and is used as the starting material. It is subjected to working to obtain the wrought product. The wrought product, which is blank material, is subjected to machining, such as lathing. However, the Si content of the Al—Si based alloy to be subjected to the above working is approximately 17% at the highest, because segregation is likely to occur in the ingot during casting, and, further, coarse, primary Si crystals precipitate with increase in the Si content, thereby decreasing the workability of the alloy. In addition, a low yield of the working is one of the factors leading to enhanced price of the parts.

Attempts have been made to apply a powder metallurgical method for the production of Al—Si based alloy parts so as to utilize an advantage of such method, i.e., production of near-net-shape, and, hence to eliminate the disadvantages of the die cast or wrought products. The ordinary sintering method involves compacting the powder in a metal die into a near-net shape and then sintering the obtained green compact. The sintering method is therefore a simple process which allows the near-net-shape to be obtained. The sintering method is therefore greatly advantageous from the viewpoint of cost.

However, the Al—Si based alloy is hard and exhibits poor compressibility and compactibility. The green compact therefore cannot be highly densified. In addition, since the Al—Si alloy has a low melting point, the sintering temperature cannot be made sufficiently high for satisfactorily promoting the sintering. It was, therefore, heretofore impossible to obtain by the sintering method parts exhibiting satisfactory mechanical properties, particularly good elongation.

Japanese Unexamined Patent Publication No. 53-128512 filed by the present applicant discloses the following sintering method.

(1) Al—Si alloy powder with Si content of from 10 to 35% by weight is annealed.

(2) The annealed Al—Si alloy powder is mixed with one or more of the following powders so as to obtain a composition consisting of 0.2–4.0% of Cu, 0.2–2.0% of Mg, 10.0–35% of Si, the balance being Al.
   (a) Cu powder
   (b) Mg powder
   (c) Al—Cu alloy powder
   (d) Al—Mg alloy powder
   (e) Cu—Mg alloy powder
   (f) Al—Cu—Mg alloy powder
   (g) Cu—Mg—Si alloy powder
   (h) Al—Cu—Mg—Si alloy powder (3) Al powder may be further mixed with (2).

(4) The mixture is compacted and then sintered in inert atmosphere.

The present inventors made experiments of the method of Japanese Unexamined Patent Publication No. 53-128512 and discovered that notwithstanding fairly good strength properties the ductility was not satisfactory.

The ductility is an important index of the material, related to its reliability. Since the conventional sintered, high Si-Al alloy exhibits poor toughness and hence low ductility, it cannot be occasionally used for parts subjected to relatively high load, such as reciprocating arm-parts.

Attempts have been made to utilize the so-called, powder forging method, so as to improve the mechanical properties of the Al—Si alloy sintered products. That is, the powder-compacting and sintering method is carried out to produce a preform, which is then hot die-forged. However, since the preform is hot-forged, it is likely to stick on the die, and the life of the die is shortened. In addition, it is difficult to finish the hot-forging with the high dimensional accuracy that is required for the parts of an office machine or the like. Therefore, final machining of the hot-forged product is inevitably required in order to enhance the dimensional accuracy.

Proposals have been made to: press-form the powder of Al—Si based alloy and hot-extrude the resultant billet.

Since extrusion of the billet is carried out at under a hot working condition, its plastic deformation is sufficient to rupturing the oxide layer on the particles of the Al—Si based alloy powder. As a result, the particles are brought into contact with each other via the metal surfaces, and the properties of Al—Si based alloy are enhanced (c.f. for example, "All of Aluminum Powder Metallurgy" (text of meeting for publishing the research and development efforts of aluminum powder metallurgy, the meeting being held by the Researching Association of Aluminum Powder-Metallurgy Technique), and "Recent Powder Metallurgy Technique of Aluminum Alloys" (30th Symposium of The Institute of Light Metals). The hot-extrusion process is, however, expensive. In addition, the product of the hot-extrusion process is an intermediate product, which must be further forged or machined to obtain the final shape of parts. The forging or machining lowers the yield and enhances the cost too greatly for the products to be used practically.

SUMMARY OF INVENTION

It is an object of the present invention to eliminate the disadvantages of the prior art as described above, and to provide a method for producing by an ordinary powder metallurgical method the Al—Si based alloy parts having near-net-shape and improved mechanical properties, particularly improved ductility. The ordinary powder metallurgical method in this context consists of compacting the powder, and then heating and sintering the green compact under vacuum or inert gas atmosphere, such as nitrogen-or argon-gas atmosphere.

It is another object of the present invention to provide starting powder for sintering, used for the above mentioned method.

It is a further object of the present invention to provide an Al—Si sintered alloy having improved mechanical properties, particularly improved ductility.

The present inventors considered in detail the compactibility of powder, as well as influence of the alloying elements upon the properties of the sintered products, compacting conditions, and sintering conditions. Although the main starting powder for sintering is Al—Si alloy in Japanese Unexamined Patent Publication No. 53-128512, the main starting powder according to the present invention is Al—Si—Cu alloy powder (A) with the pre-alloyed Cu, with which powder (A) the Mg alone or the mother alloy powder (B) is mixed. It was discovered that sintered parts having improved ductility can be produced by means of compacting and then sintering the starting powder under appropriate conditions selected for the starting powder.

The present invention is hereinafter described in more detail.

The main powder (A) according to the present invention consists of from 10.0–35.0% by weight of Si and from 0.2 to 2.0% by weight of Cu, the balance being Al and unavoidable impurities.

The mixed starting powder according to the present invention consists of a mixture of the main powder (A) and at least one metal or aluminum-alloy powder selected from (a)–(i) in such amounts that the composition of the mixture is from 0.2 to 2.0% by weight of Mg, from 10.0 to 35.0% by weight of Si, from 0.2 to 4.0% by weight of Cu, the balance being Al and unavoidable impurities.

(a) Mg powder
(b) Al—Mg powder
(c) Al—Cu powder
(d) Al—Mg—Si powder
(e) Al—Cu—Si powder
(f) Al—Mg—Cu powder
(g) Al—Mg—Cu—Si powder
(h) Mg—Cu powder
(i) Mg—Cu—Si powder The sintered aluminum-alloy according to the present invention is characterized by the composition, process and structure. It is produced by a process comprising sintering the mixed aluminum-alloy powder consisting of from 0.2 to 2.0% by weight of Mg, from 10.0 to 35.0% by weight of Si, from 0.2 to 4.0% by weight of Cu, and the balance being Al and unavoidable impurities, and composed of Al matrix and Si particles, wherein particles of main powder (A) and particles of the mother-alloy powder (B) are indistinguishable under an optical microscope.

The mechanical properties of the sintered aluminum alloy according to the present invention are as follows.

A sintered aluminum-alloy containing from 10 to 17% of Si exhibits 22 kgf/mm$^2$ or more of tensile strength and 4% or more of elongation. The tensile strength and elongation of sintered and repressed and $T_4$ heat treated alloy are 22 kgf/mm$^2$ or more and 5% or more, respectively.

A sintered aluminum-alloy containing from more than 17 to 22% of Si exhibits 23 kgf/mm$^2$ or more of tensile strength and 2% or more of elongation. The tensile strength and elongation of sintered and repressed and $T_4$ heat-treated alloy are 24 kgf/mm$^2$ or more and 4% or more, respectively.

A sintered aluminum-alloy containing from more than 22 to 35% of Si exhibits 18 kgf/mm$^2$ or more of tensile strength and 0.7% or more of elongation. The tensile strength and elongation of sintered and repressed and $T_4$ heat-treated alloy are 19 kgf/mm$^2$ or more and 1% or more, respectively.

In the method for producing a sintered aluminum-alloy according to the present invention, the mixed, aluminum alloy powder is compressed at a pressure of from 2 to 8 tonf/cm$^2$ and is sintered in a vacuum or inert atmosphere.

First, the final alloy-composition is described.

Si is added to the Al alloy so as to lower the coefficient of thermal expansion. The Si content of 10% by weight or more is necessary for attaining a low coefficient of thermal expansion. Particularly, the Si content of a sintered alloy is determined in accordance with the coefficient of thermal expansion which is required for the final sintered parts. On the other hand, when the Si content exceeds 35% by weight, the obtained mechanical properties are insufficient for practical use of the sintered parts. The additive amount of Si is therefore from 10 to 35% by weight.

Mg is an important element which contributes to solid-solution strengthening and to precipitation-hardening together with Si. However, when Mg is added in excessive amount, the ductility and toughness are impaired. The additive amount of Mg is therefore from 0.2 to 2.0% by weight.

Cu is also an important element which contributes to precipitation-hardening, hence enhancing strength. Cu must also be added within a range so as not to incur impairment due to excessive addition. The additive amount of Cu is therefore from 0.2 to 4.0% by weight.

The starting powder according to the present invention is now described with regard to the composition and the mixture method of the powders to obtain the final alloy-composition.

Two kinds of powder are mixed to provide the starting powder according to the present invention. One kind of powder is the main powder (A) which amounts to 80% or more of the starting powder. The other powder is Mg powder or mother-alloy powder (B).

The main powder (A) is first described. The main powder (A) contains from 10 to 35% by weight of Si, and from 0.2 to 2.0% by weight of Cu, the balance being Al and impurities. In the impurities, particularly the content of Mg should desirably be suppressed as low as possible. Si content of 10% by weight or more is necessary for decreasing the coefficient of thermal expansion. The coefficient of thermal expansion linearly decreases with the increase in the Si content. However, when the Si content exceeds 35% by weight, hard Si crystals increase in the Al—Si based powder, with the result that the relatively soft Al phase decreases in the Al—Si powder. As a result, compactibility and compressibility of the main powder (A) considerably deteriorates. In addition, since the Si phase, which is brittle, increases, and the Al phase, which is ductile, decreases, a dense green compact cannot be obtained when the main powder (A) is mixed with the mother-alloy powder (B) and then compacted. This in turn leads to deteriorating the mechanical properties of the sintered parts. The additive amount of Si is therefore from 10 to 35% by weight.

Cu is a precipitation-hardening element which contributes to enhancing the strength of the final alloy. In addition, it was discovered through research by the present inventors that Cu, which was added to the Al—Si based alloy in an appropriate amount, promotes the sintering of the final Al—Si based alloy; whereas Mg, contrary to Cu, impedes the sintering. Cu is, therefore, alloyed with the Al—Si alloy powder so as to provide the main powder (A). However, when the Cu content exceeds 2% by weight, the melting point of Al—Si alloy so falls that it becomes necessary to set the sintering temperature of the final Al alloy low. This, in turn, makes it difficult to promote the sintering of the main powder (A) and mother-alloy powder (B), hence to finally attain excellent mechanical properties in the process. The Cu content of the main powder (A) is set at 2% by weight or less for the reasons as described above.

Two or more different kinds of powder may be mixed to provide the main powder (A). For example, powders having different Si content are mixed to adjust the Si content to a value which can provide the desired coefficient of thermal expansion.

Mg is an important alloying element in aluminum alloys and contributes to solid-solution strengthening and/or precipitation-hardening. In addition, it is known in the field of vacuum-brazing of aluminums that Mg in appropriate amount improves the brazing property of aluminum. For the reasons as described above, there is a trend in the field of powder metallurgy for Mg to be positively used as an alloying element.

The present inventors made a detailed study of the influence of Mg and discovered the following. That is, Mg exerts a seriously adverse effect depending upon the method for its addition, notwithstanding the advantages of Mg as described above. More specifically, when Mg is preliminarily alloyed with the main powder (A) the sintered product produced by using such main powder (A) virtually does not exhibit elongation.

The sintering of main powder (A) can be promoted by means of alloying Mg in the mother-alloy powder or using Mg alone but not alloying the Mg in the main powder (A). The mechanical properties of the final alloy can, therefore, be successfully improved.

Mg powder and the mother-alloy powder (B) are now described. These powders are used, for the reason as described above, to supply Mg, which cannot be preliminarily added to the main powder (A). Another reason is that an appropriate amount of liquid phase is formed during sintering to promote the sintering by the so-called "liquid phase sintering".

The "liquid phase sintering" realized in the present invention is now described. Al—Si alloy, to which the main powder (A) belongs, forms an eutectic at a low melting point. When a mixture of the main powder (A) and Mg or mother-alloy powder (B) is sintered at a temperature higher than that of the eutectic temperature of main powder (A), a large proportion of the mixture is melted to deform the compact. The sintering temperature therefore cannot De elevated. It is difficult to thoroughly promote diffusion and sintering. The "liquid phase sintering" realized by utilizing the Mg powder or mother-alloy powder (B) provides a solution of the problems described above. The mother-alloy powder (B) has a low melting point in itself. When the mother-alloy powder (B) is caused to react with the main powder (A), they (A,B) form an eutectic which has a lower melting point than the melting point of the mother-alloy powder (B). During sintering of a mixure of the main powder (A) in a major proportion and mother-alloy powder (B) in a minor proportion, an appropriate amount of the liquid phase is formed such that the liquid phase spreads entirely throughout the starting powder, wetting it. The sintering is thereby promoted.

When the amount of liquid phase is small, the effects of liquid phase sintering are not attained. On the other hand, when the amount of liquid phase is great, such phenomenon as exudation occurs so that it becomes difficult to hold the shape of the sintered parts. Desirably, the mother-alloy powder (B) is mixed in the starting powder in an amount of less than 20% by weight. Desirably, the mother-alloy powder (B) has a solidus point (melting-starting temperature) in the range of from 450° to 550° C.

The specific kinds (a)–(i) of the mother-alloy powder (B), their advantages and reasons for selecting them are now described. Mg powder (a) is a soft powder and has an advantage that it does not impair the compactibity and compressibility of the starting powder. The Al—Mg powder (b) and the Al—Mg—Si powder (d) are advantageous as compared with the Mg powder (a) in the fact that the melting-starting temperatures of (b) and (d) are lower than that of (a) due to alloying of Mg with Al and Al—Si, respectively. They (b, d) are also advantageous in the point that: the amount of powder (b) or (d) is greater than (a); and the liquid phase generated at the initial stage of sintering is greater than in the case of using the Mg powder (a).

The Al—Cu powder (c) and the Al—Cu—Si powder (e) are used for adding Cu to the starting powder and are used in combination with the powder (a), (b) or (c). Since the melting point of Cu alone is high, the eutectic reaction for forming the liquid phase occurs with difficulty. Thorough diffusion and homogenization between the Cu powder and main powder (A) therefore cannot be expected under such a sintering condition, that the main powder (A) is kept at a temperature lower than its melting point. Cu is therefore alloyed with Al or Al—Si according to the present invention so as to quickly form the liquid phase and spread it in the starting powder during sintering. The particles of starting powder are therefore wetted by the liquid phase.

The Mg—Cu powder (h) is advantageous in the point that, when its appropriate composition is selected, only one kind of the mother-alloy powder (B) is used, i.e., no other kind of mother-alloy powder (B) is needed.

The Al—Mg—Cu powder (f), Al—Mg—Cu—Si powder (g), and Mg—Cu—Si powder (h) correspond to alloys with additive(s) of Al, Al—Si, and Si to the Mg—Cu powder (h), respectively. The addition of these elements is made to adjust the solidus point of the Mg—Cu powder (h). These powders (f), (g) and (h) allow broader adjustment of the additive amount of mother-alloy powder (B) than the Mg—Cu powder (h). In addition, production of the Mg—Cu powder (h) is rather difficult, because Mg, which is active and has lower density than Cu, is difficult to alloy with Cu by melting. This disadvantage of powder (h) is eliminated by the powders (f), (g), and (h).

Two or more kinds of the mother-alloy powder (B) may be mixed with one another to provide the final composition of the mother-alloy powder for the purposes of: finely adjusting the formation amount of liquid phase; and, utilizing the raw material which is commercially available in the market.

An alloy of two or more kinds of raw materials is prepared by melting and crushing or is prepared by atomizing. The particle size of powder is such that 90% or more of the particles is finer than 50 mesh and coarser than 635 mesh. A powder, whose 10% or more of the particle coarser than 50 mesh, is difficult to fill in a metal die with at high density. A powder whose particle size is 10% or more finer than 635 mesh, has poor flowability and is liable to enter the clearance between the metal die and the punch during the compacting, to cause sticking. Either too fine or too coarse powder is therefore inappropriate.

The main powder (A) and the mother-alloy powder (B) may be heated to anneal and soften the same, thereby improving the compactibility and compressibility. A lubricant may be mixed with the powders (A) and (B). The lubricant amount is desirably 0.5–2% by weight for the following reasons. The lubricant in an amount of 0.5% by weight or less is ineffective for attaining the lubrication of the powders (A) and (B) with the die-wall. When the lubricant amount is 2% by weight or more, the flowability and compactibility of the powders are impaired. In addition, the lubricant, which evaporates at the sintering, detrimentally contaminates the interior of a sintering furnace. Such vapor also contaminates the gas-exhaustion system of a vacuum-sintering furnace. The lubricant is preferably one that evaporates completely at a temperature lower than the sintering temperature, so as not to exert any detrimental influence upon the material properties of sintered parts. From the point of view of avoiding this contamination, amide-based lubricants, such as ethylene-bis-stearamide, are preferred to metallic lubricants, such as zinc stearate, lithium stearate and aluminum stearate.

The constituents of the sintered alloy, which is produced by sintering the mixture of the main powder (A) and mother-alloy powder (B), is the Al matrix and the Si particles. When the sintered alloy is subjected to aging, such precipitated particles as $Mg_2Si$ and $CuAl_2$ are also constituents.

The particles of the main powder (A) and mother-alloy powder (B) are converted by the sintering to an integral body, in which the particles of the powders (A) and (B) are indistinguishable in the sintered alloy by an optical microscope. Therefore, regardless of the various combinations of the powders (A) and (B), alloying elements such as Si, Cu, and Mg uniformly diffuse in a sintered compact. As a result, the mechanical properties as described above are attained.

The production conditions are now described. The raw material-powder used in the present invention is air-atomized powder or inert-gas atomized powder. The compacting pressure of the raw material powder should be 2 tonf/cm$^2$ or more, because at pressure of less than 2 tonf/cm$^2$ the densification of the green compact is so poor that the contact between the particles of the powder is unsatisfactory. In this case, the obtained sintered product has low strength and low elongation. The density of a green compact can be enhanced by increasing the compacting pressure. Compacting pressure exceeding 8 tonf/cm$^2$ is, however, inappropriate from the viewpoint of practical operation, because such problems occur as the shortening of the metal die life, the lamination, and adhesion of a punch on the metal die.

The raw material powder may be heated to a temperature of from 70° to 250° C. and be then compacted in the heated state. The density of a green compact can thus be enhanced.

The sintering atmosphere should be vacuum or inert, such as nitrogen or argon gas, so as to prevent the oxidation of the aluminum alloys, which are active, and to satisfactorily promote the sintering. The vacuum degree of the vacuum sintering-atmosphere should be 0.1 torr or less, desirably 0.01 torr or less. It is possible to replace the atmosphere of a sintering furnace with vacuum and then to flow a small amount of inert gas, such as nitrogen gas, into the sintering furnace during sintering, while maintaining the reduced gas pressure. This method is effective for enhancing the removal effect of gases from the green compact during sintering. Purity of gases, e.g., nitrogen and argon, is important in the case of sintering in an inert-gas atmosphere. Since the moisture contained in the gases particularly exerts a detrimental influence upon the material properties of sintered parts, the dew point should be controlled low, desirably −40° C. or less.

The sintering temperature is desirably 500° C. or more but 570° C. or less, because at a sintering temperature of less than 500° C. the diffusion is unsatisfactory, while at a sintering temperature higher than 570° C. the liquid phase is formed in such a great amount as to make it difficult to maintain the shape of sintered parts.

Sintered parts produced by the method as described above may be repressed to densify the structure and to further enhance the mechanical properties. The repressing is usually carried out for the purpose of sizing, i.e., enhancing the dimension accuracy of sintered parts. The conditions for repressing according to the present invention are selected so as to enhance dimensonal accuracy, to densify the structure and to enhance the mechanial properties. The repressing pressure is usually in the range of from 3 to 11 tonf/cm$^2$.

Re-sintering of the repressed parts can further improve the mechanical properties, particularly the ductility. When the structure, which has been densified by the repressing, undergoes the re-sintering, the diffusion and sintering are further promoted. The re-sintering conditions are basically the same as those of the sintering.

The following table illustrates the effects of repressing and re-sintering for densification.

TABLE 1

| | Relative Density | |
|---|---|---|
| Si content | Sintered parts | Re-pressed parts Re-sintered parts |
| 12(−16%) | 82–88% | 89% or more |
| 20(−25%) | 80–86% | 88% or more |
| 30(−35%) | 78–84% | 87% or more |

The heat-treatment of sintered parts, which contain Cu, Mg and Si, allows them to function to improve the mechanical properties. The sintered parts may therefore be subjected to solution heat treament and subsequent aging, which is ordinarily carried out in the conventional aluminum alloys. Such heat treatment allows the adjustment or enhancement of the mechanical properties of the sintered parts.

The present invention is hereinafter described by way of examples and referring to the drawings.

EXAMPLE 1

Figure 1:
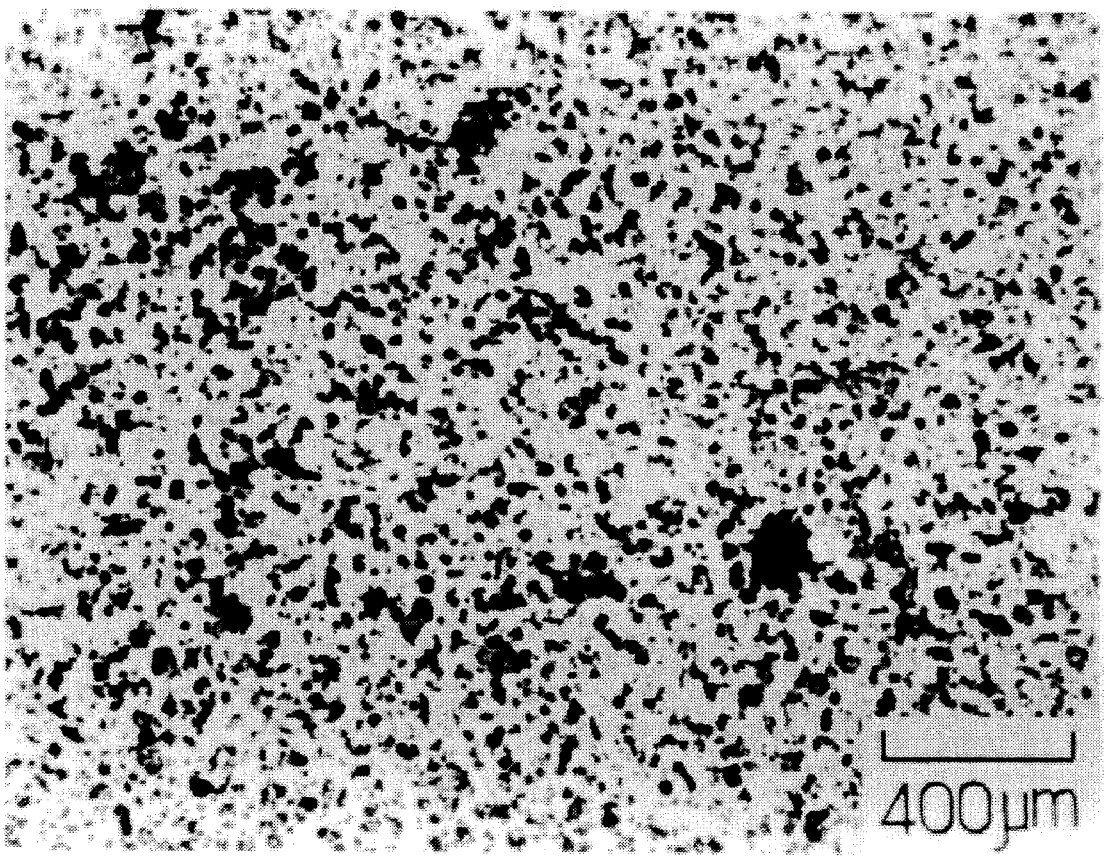
FIG. 1 is a photograph showing an optical microscope-structure of the sintered alloy according to the present invention (magnification-×50).

The main powder (A) as given in Table 2 was prepared by the air-atomizing method and then sieved to a particle size of from 100 mesh to 325 mesh. Mg powder and the mother-alloy powder as given in Table 3 were prepared by the inert-gas atomizing method or air-atomizing method and then sieved to a particle size of from 100 mesh to 325 mesh. These powders were mixed as given in Nos. 1 through 7 and 14 through 17 in Table 4 to provide an approximate composition consisting of Al-12% Si-1% Cu-0.5% Mg. An amide-based lubricant was added to the powder mixture in an amount of 1% by weight, thereby obtaining the starting powder. This starting powder was compacted at a pressure of 4 tonf/cm$^2$ into the form of a tensile-test specimen stipulated in JIS Z 2550. The obtained green compacts were then sintered at 550° C. in vacuum at 0.01 torr. The obtained sintered specimens were subjected to the $T_4$ heat treatment. The tensile test was then carried out. The result of this test is also given in Table 5. In addition to the inventive examples, the comparative examples and their results are also given in Tables 4 and 5, respectively.

EXAMPLE 2

Alloys A 2–A 4 as given in Table 2 were prepared by the air-atomizing method and then sieved to a particle size of from 100 mesh to 325 mesh. Alloys B6 as given in Table 3 were prepared by the air-atomizing method and then sieved to a particle size of from 100 mesh to 325 mesh. These alloy powders were mixed as given in Nos. 8 through 10 in Table 4. An amide-based lubricant was added to the powder mixture in an amount of 1% by weight, thereby obtaining the starting powder. This starting powder was compacted, sintered and heat-treated, and then subjected to the tensile-strength test under the same conditions as in Example 1. The results are given in Nos. 8 through 10 of Table 5. In addition to the inventive examples, the comparative examples and their results are also given in Tables 4 and 5, respectively.

EXAMPLE 3

Several sintered specimens of Examples 1 and 2 were repressed at a pressure of 7 tonf/cm$^2$ and then re-sintered under the same condition as in the sintering (Nos. 11 through 13 of Table 4). The re-sintered parts were subjected to the $T_4$ heat treatment and then to tensile test. The results are given in Nos. 11 through 15 of Table 5.

Referring to FIG. 1, the optical microscope-structure of sintered material No. 11 is shown. The spots, which appear black in FIG. 1, are pores. In the lower right part of FIG. 1, there is one pore of approximately 100 μm in diameter. There are further several pores of approximately 20 μm in diameter. Grey spots, which appear over the entire figure, are Si crystals having a diameter of approximately 10 to 40 μm. The white part is the aluminum matrix.

EXAMPLE 4

Powder A 1 given in Table 2 was prepared by the air-atomizing method and then sieved to a particle size of from 100 mesh to 325 mesh. Alloys B14 and B15 as given in Table 3 were prepared by the air-atomizing method and then sieved to a particle size of from 100 mesh to 325 mesh. These alloy powders were mixed in the proportion of A 1: B14 or B15=95: 5, as given in Nos. 18 and 19 of Table 4. An amide-based lubricant was added to the powder mixture in an amount of 1% by weight, thereby obtaining the starting powder. This starting powder was compacted, sintered and heat-treated, and then subjected to the tensile test under the same conditions as in Example 1. The results are given in Table 5.

EXAMPLE 5

Figure 2:
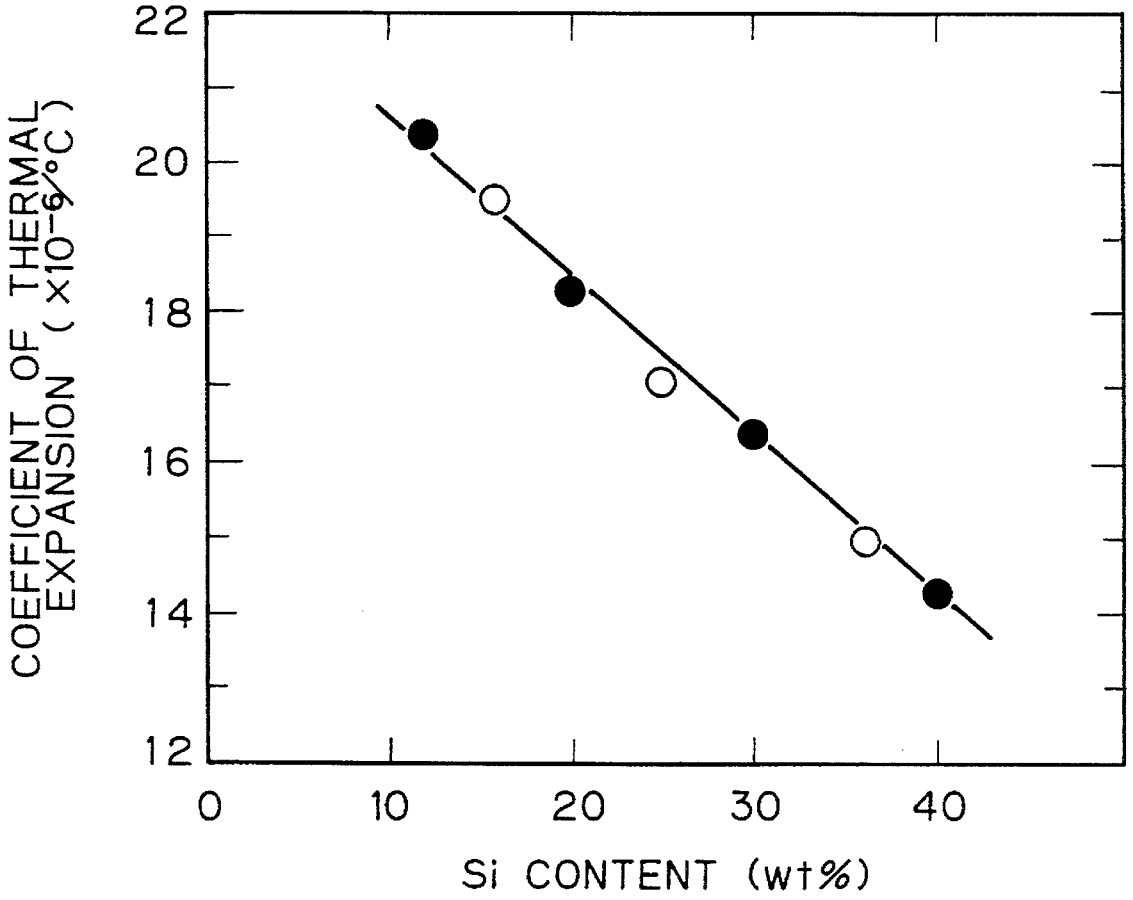
FIG. 2 is graph showing the relationship between the Si content of Al—Si based alloy and the coefficient of thermal expansion at a temperature range of from 40° to 100° C.

The relationship between the coefficient of thermal expansion and the Si content of several sintered alloys according to the examples is shown in FIG. 2. The solid circles correspond to the inventive samples Nos. 4, 8, 9 and comparative sample 5, in which the Si content of Al—Si—Cu alloy powder, i.e., Powder A (main starting powder A), is adjusted to obtain the final Si content.

In the case of open circles, different kinds of the Al—Si—Cu alloy powder were combined to obtain the final Si content. The Si content of approximately 16% was obtained by mixing the inventive powder of sample Nos. 4 and 8 in a proportion of 2:1. The Si content of approximately 25% was obtained by mixing the inventive powders of sample Nos. 8 and 9 in a proportion of 1:1. The Si content of approximately 35% was obtained by mixing the inventive powder of sample No. 8 and the comparative powder of sample No. 5 in a proportion of 1:4. The mixed powders were subjected to the same production process as in Example 1. As is clear from FIG. 2, the coefficient of thermal expansion of the 12% Si-containing alloy is 20.4×10$^{-6}$/°C. The coefficient of thermal expansion almost linearly decreases with the increase in the Si content. Although the coefficient of thermal expansion is very low at 40% Si content, the mechanical properties of the 40% Si-containing alloy are too poor for practical use.

TABLE 2

| | Kinds of Alloys | Chemical Composition (wt %) Si | Cu | Mg | Al |
|---|---|---|---|---|---|
| Inventive | A 1 | 12 | 0.5 | — | Bal |
| | A 2 | 20 | 0.5 | — | Bal |
| | A 3 | 30 | 0.5 | — | Bal |
| | A 4 | 12 | 1.5 | — | Bal |
| Comparative | A 5 | 12 | — | — | Bal |
| | A 6 | 12 | — | 0.5 | Bal |
| | A 7 | 12 | 0.5 | 0.5 | Bal |
| | A 8 | 12 | 1.0 | 0.5 | Bal |
| | A 9 | 40 | 0.5 | — | Bal |

TABLE 3

| Kinds of Metal and Alloys | Chemical Composition (wt %) Si | Cu | Mg | Al |
|---|---|---|---|---|
| B 1 | — | — | 100 | — |
| B 2 | — | — | 20 | Bal |
| B 3 | — | 20 | — | Bal |
| B 4 | 20 | — | 20 | Bal |
| B 5 | 20 | 20 | — | Bal |
| B 6 | 20 | 10 | 10 | Bal |
| B 7 | — | 10 | 10 | Bal |
| B 8 | — | 80 | 20 | — |
| B 9 | 20 | 60 | 20 | — |
| B10 | 10 | 5 | 5 | Bal |

TABLE 3-continued

| Kinds of Metal and Alloys | Chemical Composition (wt %) Si | Cu | Mg | Al |
|---|---|---|---|---|
| B11 | 30 | 15 | 15 | Bal |
| B12 | 10 | — | 5 | Bal |
| B13 | 30 | — | 15 | Bal |
| B14 | 6 | 30 | 10 | Bal |
| B15 | 6 | 40 | 6 | Bal |

TABLE 4

| | | Powder (A) | Powder (B) | Mixing Proportions (wt %) (A) | (B) | (B) | Composition of Mixtures (wt %) Si | Cu | Mg | Al | Remarks |
|---|---|---|---|---|---|---|---|---|---|---|---|
| Inventive | 1 | A 1 | B1 + B3 | 97.0 | 0.5 | 2.5 | 11.6 | 0.99 | 0.5 | Bal | Example 1 |
| | 2 | A 1 | B2 + B3 | 95.0 | 2.5 | 2.5 | 11.4 | 0.98 | 0.5 | Bal | " |
| | 3 | A 1 | B4 + B5 | 95.0 | 2.5 | 2.5 | 12.4 | 0.98 | 0.5 | Bal | " |
| | 4 | A 1 | B6 | 95.0 | 5.0 | — | 12.4 | 0.98 | 0.5 | Bal | " |
| | 5 | A 1 | B7 | 95.0 | 5.0 | — | 11.4 | 0.98 | 0.5 | Bal | " |
| | 6 | A 1 | B2 + B8 | 96.5 | 1.9 | 0.6 | 11.6 | 0.98 | 0.5 | Bal | " |
| | 7 | A 1 | B2 + B9 | 96.5 | 1.9 | 0.6 | 11.6 | 0.98 | 0.5 | Bal | " |
| | 8 | A 2 | B6 | 95.0 | 5.0 | — | 20.0 | 0.98 | 0.5 | Bal | Example 2 |
| | 9 | A 3 | B6 | 95.0 | 5.0 | — | 29.5 | 0.98 | 0.5 | Bal | " |
| | 10 | A 4 | B6 | 95.0 | 5.0 | — | 12.4 | 1.93 | 0.5 | Bal | " |
| | 11 | A 1 | B6 | 95.0 | 5.0 | — | 12.4 | 0.98 | 0.5 | Bal | Example 3 |
| | 12 | A 2 | B6 | 95.0 | 5.0 | — | 20.0 | 0.98 | 0.5 | Bal | " |
| | 13 | A 3 | B6 | 95.0 | 5.0 | — | 29.5 | 0.98 | 0.5 | Bal | " |
| | 14 | A 1 | B10 | 90.0 | 10.0 | — | 11.8 | 0.95 | 0.5 | Bal | Example 1 |
| | 15 | A 1 | B11 | 96.7 | 3.3 | — | 12.6 | 0.98 | 0.5 | Bal | " |
| | 16 | A 1 | B12 + B5 | 85.0 | 10.0 | 5.0 | 11.2 | 1.0 | 0.5 | Bal | " |
| | 17 | A 1 | B13 + B5 | 91.7 | 3.3 | 5.0 | 11.9 | 1.0 | 0.5 | Bal | " |
| | 18 | A 1 | B14 | 95.0 | 5.0 | — | 11.7 | 1.98 | 0.5 | Bal | Example 4 |
| | 19 | A 1 | B15 | 95.0 | 5.0 | — | 11.7 | 2.48 | 0.3 | Bal | " |
| Comparative | 1 | A 5 | B2 + B3 | 92.5 | 5.0 | 2.5 | 11.1 | 1.0 | 0.5 | Bal | Example 1 |
| | 2 | A 6 | B3 | 95.0 | 5.0 | — | 11.4 | 1.0 | 0.48 | Bal | " |
| | 3 | A 7 | B3 | 97.5 | 2.5 | — | 11.7 | 0.99 | 0.49 | Bal | " |
| | 4 | A 8 | — | 100.0 | — | — | 12.0 | 1.0 | 0.5 | Bal | " |
| | 5 | A 9 | B6 | 95.0 | 5.0 | — | 39.0 | 0.98 | 0.5 | Bal | Example 2 |

TABLE 5

| | Tensile Strength (kgf/mm²) | Elongation (%) | Coefficient of Thermal Expansion (×10⁻⁶/°C.) 40–100° C. | 40–200° C. | Remarks |
|---|---|---|---|---|---|
| Inventive | | | | | |
| 1 | 25.2 | 4.8 | 20.5 | 21.6 | Example 1 |
| 2 | 24.5 | 4.7 | 20.5 | 21.6 | Example 1 |
| 3 | 25.8 | 5.1 | 20.3 | 21.4 | Example 1 |
| 4 | 24.6 | 6.7 | 20.4 | 21.4 | Example 1 |
| 5 | 25.8 | 6.0 | 20.5 | 21.5 | Example 1 |
| 6 | 22.8 | 4.5 | 20.4 | 21.5 | Example 1 |
| 7 | 23.4 | 4.7 | 20.4 | 21.6 | Example 1 |
| 8 | 23.4 | 2.0 | 18.3 | 19.5 | Example 2 |
| 9 | 18.9 | 0.7 | 16.4 | 16.6 | Example 2 |
| 10 | 26.2 | 5.2 | 21.1 | 21.2 | Example 2 |
| 11 | 27.5 | 8.0 | 20.2 | 21.4 | Example 3 |
| 12 | 24.2 | 3.7 | 18.2 | 19.3 | Example 3 |
| 13 | 23.4 | 1.2 | 16.1 | 16.6 | Example 3 |
| 14 | 23.8 | 4.9 | 20.4 | 21.4 | Example 1 |
| 15 | 24.6 | 5.1 | 20.1 | 21.6 | Example 1 |
| 16 | 22.9 | 4.4 | 20.5 | 21.7 | Example 1 |
| 17 | 23.6 | 4.8 | 20.5 | 21.3 | Example 1 |
| 18 | 26.8 | 4.7 | 20.1 | 21.2 | Example 4 |
| 19 | 27.9 | 2.6 | 20.3 | 21.2 | Example 4 |
| Comparative | | | | | |
| 1 | 23.6 | 2.1 | 20.5 | 21.4 | Example 1 |
| 2 | 15.0 | 0.3 | 20.6 | 21.6 | Example 1 |

TABLE 5-continued

| | Tensile Strength (kgf/mm$^2$) | Elongation (%) | Coefficient of Thermal Expansion ($\times 10^{-6}$/°C.) 40–100° C. | 40–200° C. | Remarks |
|---|---|---|---|---|---|
| 3 | 17.0 | 0.5 | 20.6 | 21.7 | Example 1 |
| 4 | 14.0 | 0.4 | 20.6 | 21.5 | Example 1 |
| 5 | 13.2 | 0.0 | 14.3 | 15.2 | Example 2 |

As is apparent from the results of Example 1 given in Table 1, the inventive sintered aluminum alloys exhibit good tensile strength and remarkable elongation. These properties are sufficient to use the alloys for practical application.

In the comparative sample No. 1, the Al—Si alloy powder, which is free of Cu and Mg, is used for the main powder (A), and particularly the elongation is inferior to that of the inventive samples. This fact indicates that the good elongation is not obtained when the main powder is free of Cu.

In the comparative sample No. 2, the Al—Si—Mg alloy powder, which contains Mg but is free of Cu, is used for the main powder (A), and the mechanical properties are poor. This fact indicates adverse influence of Mg contained in the main powder (A).

In the comparative sample No. 3, the Al—Si—Mg—Cu powder, which contains both Mg and Cu, is used for the main powder (A), and the mechanical properties are likewise poor. This fact indicates that the simultaneous addition of Mg and Cu in the main powder (A) exerts an adverse effect upon the mechanical properties.

In the comparative sample No. 4, the mother-alloy powder (B) is not used, that is, the main powder (A) supplies all the Cu and Mg necessary for the sintered aluminum alloy. Good mechanical properties are likewise not obtained, because of the absence of the mother-alloy powder (B) and hence the liquid-phase sintering.

In Example 2, the Si content is higher than that of Example 1, i.e., approximately 20% and 30%. As is apparent from Table 5, mechanical properties, particularly elongation, are greatly decreased with the increase in the Si content. When the Si content is approximately 20%, the mechanical properties are such that the material produced by the inventive method is to some extent practically usable. On the other hand, when the Si content is approximately 30%, the practical use of the material produced by the inventive method becomes difficult. When the Si content is as high as 40% in the comparative sample No.5, the elongation is 0%, so that the material is practically unusable.

In Example 3, the repressing and re-sintering are carried out. The mechanical properties are further improved, particularly in Sample No. 13. The repressing and re-sintering are therefore particularly effective for improving the mechanical properties, when the Si content is high.

EXAMPLE 6

The relative density of the sintered alloys according to the above Examples was measured. The results are given in the following table.

TABLE 6

| Sample No. | Si content | Relative density |
|---|---|---|
| 1–7 | 12% | 86.5–88% |
| 8 | 20% | 87% |
| 9 | 30% | 83% |
| 11 | 12% | 98% |
| 12 | 20% | 96% |
| 13 | 30% | 93% |

We claim:

1. An aluminum-alloy starting powder mixture for producing liquid-phase sintered aluminum-alloy parts having a near net shape produced by a powder compaction using a die and liquid, phase sintering, which consists of an unsintered physical mixture of at least two powders of (1) 80% or more of an aluminum-alloy main powder consisting of from 10.0 to 22% by weight of Si, from 0.2 to 2.0% by weight of Cu, and the balance Al and unavoidable impurities and (2) 20% or less of at least one metal or mother-alloy powder selected from groups (a)–(i) in such an amount and combination that the composition of the mixture is from 0.2 to 2.0% by weight of Mg, from 10.0 to 22% by weight of Si, from 0.2 to 4.0% by weight of Cu, and the balance being Al and unavoidable impurities, wherein (a) Mg powder (b) Al—Mg powder (c) Al—Cu powder (d) Al—Mg—Si powder (e) Al—Cu—Si powder (f) Al—Mg—Cu powder (g) Al—Mg—Cu—Si powder (h) Mg—Cu powder (i) Mg—Cu—Si powder.

2. A mixed aluminum-alloy powder according to claim 1, wherein the Si content of the mixture is from 10 to 17% by weight.

3. A mixed aluminum-alloy powder according to claim 1, wherein the Si content of the mixture is from more than 17 to 22% by weight.

4. A mixed aluminum-alloy powder according to claim 1, wherein the Mg content is about 0.5% by weight.

5. Sintered parts having a near net shape and consisting of a sintered aluminum-alloy produced by a process comprising compaction using a die and liquid phase sintering such that a liquid phase spreads entirely throughout the starting powder in a vacuum or an inert atmosphere and $T_4$ heat treatment, of a mixed aluminum-alloy powder consisting of an unsintered mixture of (1) aluminum-alloy main powder consisting of from 10.0 to 22% by weight of Si, from 0.2 to 2.0% by weight of Cu, and the balance Al and unavoidable impurities and (2) at least one metal or mother-alloy powder selected from the groups (a)–(i) in such an amount and combination that the composition of the mixture is from 0.2 to 2.0% by weight of Mg, from 10.0 to 22% by weight of Si, from 0.2 to 4.0% by weight of Cu, and the balance being Al and unavoidable impurities, wherein (a) Mg powder (b) Al—Mg powder (c) Al—Cu powder (d) Al—Mg—Si powder (e) Al—Cu—Si powder (f) Al—Mg—Cu powder (g) Al—Mg—Cu—Si powder (h) Mg—Cu powder (i) Mg—Cu—Si powder, wherein particles of the aluminum-alloy main powder and particles of the at least one powder (a) through (i) are indistinguishable under an optical microscope.

6. A sintered aluminum alloy according to claim 5, wherein the Si content of the mixture is from 10 to 17% by weight and the alloy exhibits 22 kgf/mm$^2$ or more of tensile strength and 4% or more of elongation.

7. A sintered aluminum alloy according to claim 5, wherein the Si content of the mixture is more than 17 to 22% by weight and the alloy exhibits 23 kgf/mm$^2$ or more of tensile strength and 2% or more or elongation.

8. A sintered aluminum alloy according to claim 5, wherein the Si content of the mixture is from 10 to 17% by weight, the sintering is followed by repressing, and the alloy exhibits 23 kgf/mm$^2$ or more of tensile strength and 5% or more of elongation.

9. A sintered aluminum alloy according to claim 5, wherein the Si content of the mixture is from more than 17 to 22% by weight, the sintering is followed by repressing, and the alloy exhibits 24 kgf/mm$^2$ or more of tensile strength and 3% or more of elongation.

10. A method for producing sintered parts having near net shape of a sintered aluminum alloy, wherein a mixed aluminum alloy powder, consisting of a mixture of (1) an aluminum-alloy main powder consisting of from 10.0 to 22% by weight of Si, from 0.2 to 2.0% by weight of Cu, and the balance Al and unavoidable impurities and (2) at least one metal or mother-alloy powder selected from the groups (a)–(i) in such an amount and combination that the composition of the mixture is from 0.2 to 2.0% by weight of Mg, from 10.0 to 22% by weight of Si, from 0.2 to 4.0% by weight of Cu, and the balance being Al and unavoidable impurities, wherein (a) Mg powder (b) Al—Mg powder (c) Al—Cu powder (d) Al—Mg—Si powder (e) Al—Cu—Si powder (f) Al—Mg—Cu powder (g) Al—Mg—Cu—Si powder (h) Mg—Cu powder (i) Mg—Cu—Si powder, is compacted in a die at a pressure of from 2 to 8 tonf/cm$^2$, is liquid-phase sintered such that a liquid phase spreads entirely throughout the starting powder in a vacuum or an inert atmosphere and subjected to $T_4$ heat treatment.

11. A method according to claim 10, wherein said mixed aluminum alloy powder is compacted at a temperature of from 70° to 250° C.

12. A method according to claim 10, wherein the sintering temperature is from 500° to 570° C.

13. A method according to claim 10, wherein a sintered product is subjected to repressing.

14. A method according to claim 13, wherein the repressing pressure is from 3 to 11 tonf/cm$^2$.

15. A method according to claim 14, wherein a repressed product is further subjected to a re-sintering.

16. The method according to claim 10, wherein the mixture is compacted at a pressure of from 2 to 8 tonf/cm$^2$, sintered in a vacuum or an inert atmosphere, solution-heat treated at 450°–530° C. and aged at room temperature for more than 6 days or aged at 150°–180° C. for 3–10 hours.

* * * * *